US007081575B1

(12) United States Patent
Pieper, Jr. et al.

(10) Patent No.: US 7,081,575 B1
(45) Date of Patent: Jul. 25, 2006

(54) MUSICAL INSTRUMENT WITH DETACHABLE NECK

(75) Inventors: Robert Walter Pieper, Jr., Bethany, CT (US); Robert Walter Pieper, III, Bethany, CT (US)

(73) Assignee: Environmental Management, Inc., Middletown, CT (US)

( * ) Notice: Subject to any disclaimer, the term of this patent is extended or adjusted under 35 U.S.C. 154(b) by 0 days.

(21) Appl. No.: 11/030,773

(22) Filed: Jan. 6, 2005

(51) Int. Cl.
*G10D 3/00* (2006.01)

(52) U.S. Cl. ..... 84/293; 84/267

(58) Field of Classification Search ..... 84/290, 84/291, 293, 267; D17/99
See application file for complete search history.

(56) References Cited

U.S. PATENT DOCUMENTS 5,347,904 A * 9/1994 Lawrence ..... 84/291
6,198,030 B1 * 3/2001 Rose ..... 84/293

* cited by examiner

*Primary Examiner*—Kimberly Lockett
(74) *Attorney, Agent, or Firm*—Bachman & LaPointe

(57) ABSTRACT

A stringed musical instrument, such as a guitar or a bass, has a body portion and a second portion, such as a neck, adapted to be attached to the body portion. The musical instrument further has a locking system for releasably securing the second portion to the body portion and for maintaining proper alignment between the body portion and the second portion. The locking system further maintains the second portion in a constant position with respect to the body portion.

13 Claims, 2 Drawing Sheets

MUSICAL INSTRUMENT WITH DETACHABLE NECK

BACKGROUND OF THE INVENTION (1) Field of the Invention

The present invention relates to a system for allowing a portion of a stringed musical instrument, such as a guitar or a bass, to be replaced.

(2) Prior Art

Many stringed musical instruments consist of a body and a neck. Typically, the body and the neck are a unitary structure. As a result, one is unable to replace a neck, such as a fretted neck, with another neck, such as a fretless neck without risking serious damage to the musical instrument.

It is known in the art to bolt on a neck to a guitar body. However, these prior art systems do not perform well because the neck secured by the bolt(s) does not stay in a constant position or in perfect alignment. As a result, the guitar is often out of tune.

SUMMARY OF THE INVENTION

Accordingly, it is an object of the present invention to provide a stringed musical instrument having a lock system which allows replacement of a portion of the musical instrument and which enables the replaced portion to stay in a constant position.

It is a further object of the present invention to provide a stringed musical instrument as above wherein the lock system allows replacement of a portion of the musical instrument in minutes.

The foregoing objects are attained by the present invention.

In accordance with the present invention, a stringed musical instrument broadly comprises a body portion, a second portion adapted to be attached to the body portion, and means for releasably securing the second portion to the body portion and for maintaining proper alignment between the body portion and the second portion.

Other details of the musical instrument with detachable neck of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
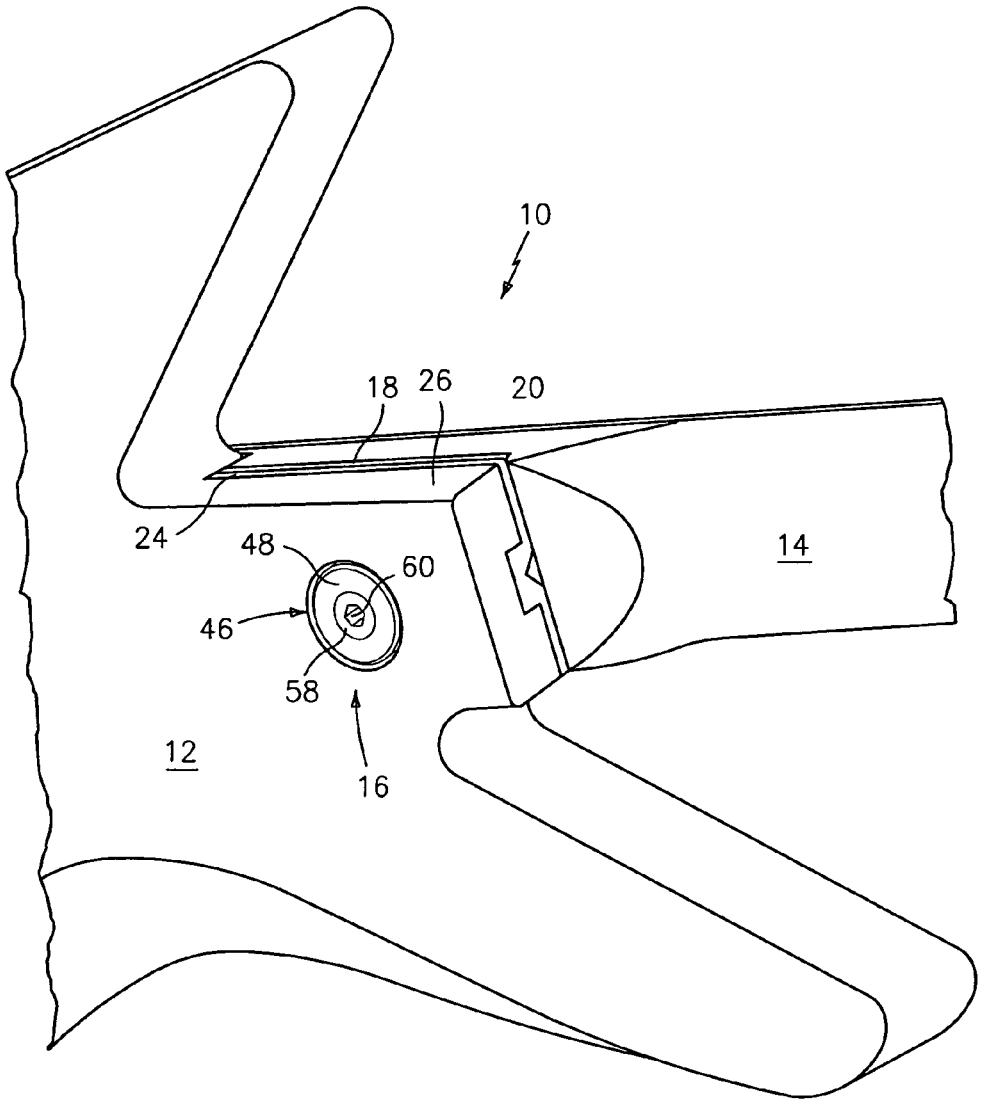
FIG. 1 is a perspective view showing an underside of a stringed musical instrument.

Referring now to the drawings, FIG. 1 illustrates a stringed musical instrument 10, such as a guitar or a bass, having a body portion 12, and a neck portion 14. The stringed musical instrument 10 may have the usual components for attaching the strings (not shown) to the instrument. For example, in the case of a guitar or a bass, the instrument

10 may have a bridge for receiving a saddle and an electro-acoustic pickup, string guides, a fingerboard, strings, and a string tensioning system.

The neck portion 14 may be a fretted neck or a fretless neck. It is releasably secured to the body portion 12 by a locking system 16 which allows the neck portion 14 to be replaced in minutes without any additional setup being required. The locking system 16 is advantageous in that the neck portion 14 goes into the same position every time without fail. The locking system 16 is also advantageous because it enables the neck portion 14 to stay in a constant position and in perfect alignment. As a result, the musical instrument 10 is never out of tune as a result of the placement of the neck portion 14 relative to the body portion 12.

Figure 2:
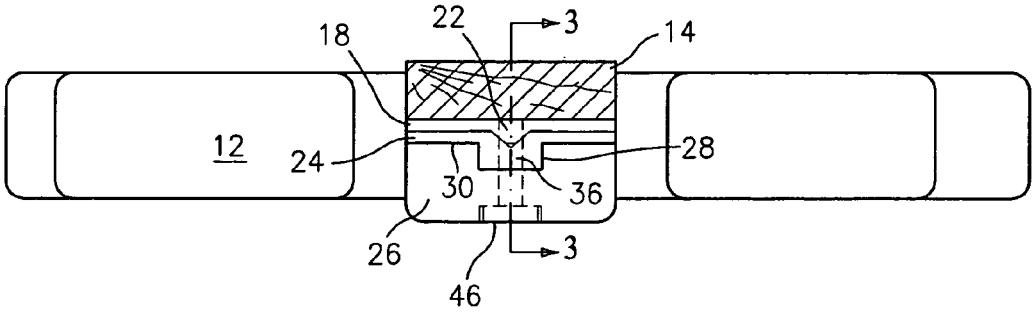
FIG. 2 is a partial sectional view of the instrument of FIG. 1 showing the locking system of the present invention.
Figure 3:
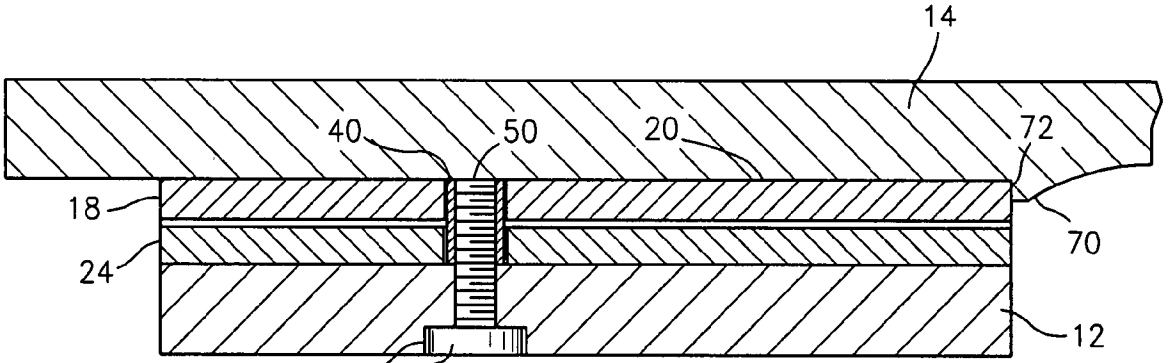
FIG. 3 is a sectional view taken along lines 3—3 in FIG. 2.
Figure 4:
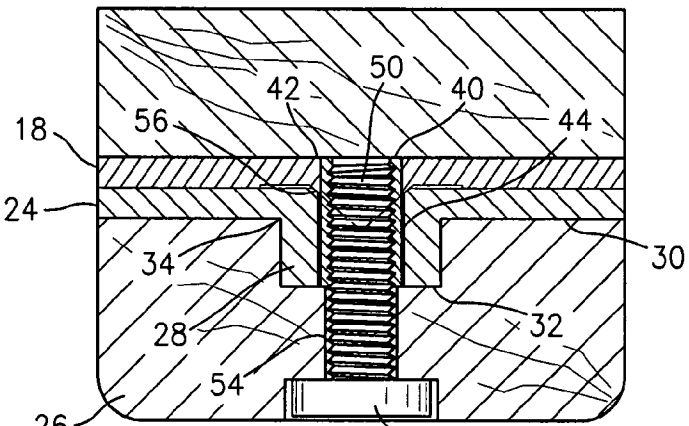
FIG. 4 is a sectional view of the locking system of the present invention.

Referring now to FIGS. 2–4, the locking system 16, in a preferred embodiment, comprises a plate member 18 attached to an underside 20 of the neck portion 14. Any suitable means known in the art, such as an adhesive, can be used to secure the plate member 18 to the underside 20. The neck portion 14 may have a section 70 which has an L-shaped region 72 for receiving an edge of the plate member 18. Such an arrangement is advantageous in that it allows proper seating of the plate member 18 when the plate member 18 is secured to the underside 20.

As shown in FIG. 2, the plate member 18 has a central located positioning member 22. While the positioning member 22 may have any desired shape, it is preferred that the positioning member 22 have a V-shape since such a shape achieves the goal of keeping the neck portion 14 in a constant position and in perfect alignment relative to the body portion 12.

The locking system 16 further has a second member 24 attached to a rear part 26 of the body portion 12. The second member 24 may be attached to the rear part 26 using any suitable means known in the art, such as an adhesive. The second member 24, as shown in FIGS. 2 and 4, has a tongue portion 28 which extends preferably at a right angle to a surface 30 of the member 24. The tongue portion 28 is seated within a groove 32 in the rear body part 26. Shoulder portions 34 support the member 24 and keep the tongue portion 28 properly seated within the groove 32.

As can be seen in FIG. 2, the member 24 has a centrally located receiving portion 36. The receiving portion 36 has a shape which corresponds to the shape of the positioning member 22. Preferably, the receiving portion 36 has a V-shape. When the neck portion 14 is secured to the body portion 12 by the locking system 16, the positioning member 22 is seated within the receiving portion 36. Due to the respective shapes of the positioning member 22 and the receiving portion 36, the neck portion 14 is maintained in a constant position and in perfect alignment with respect to the body portion 12.

The positioning member 22 and the receiving portion 36 preferably extend along a central longitudinal axis of the instrument 10. The positioning member 22 and the receiving portion 36 may have any desired length. The length should be such as to insure proper alignment of the neck portion 14 and the body portion 12. Similarly, the depth of the positioning member 22 and the depth of the receiving portion 36 should be such as to insure the proper alignment of the neck portion 14 and the body portion 12.

The locking system further includes a threaded sleeve 40. The threaded sleeve 40 is positioned within a bore 42 in the plate member 18. The threaded sleeve 40 may be secured to the plate member 18 using any suitable means known in the art. For example, the threaded sleeve 40 may have external threads which engage threads on the side walls of the bore 42. Alternatively, the outer walls of the threaded sleeve 40 may be adhesively secured to the walls of the bore 42.

As can be seen from FIGS. 2 and 3, the threaded sleeve 40 also extends through a bore 44 in the tongue portion 28. The bore 44 is aligned with the bore 42. Here again, the threaded sleeve 40 may be secured to the sidewalls of the bore 44 using any suitable means known in the art, such as those discussed above.

The locking system 16 further includes a fastening member or neck bolt 46. The fastening member 46 has a head portion 48 and a threaded portion 50. The head portion 48 is positioned within a recess 52 in the body portion 12. The threaded portion 50 extends through a bore 54 in the body portion 12 and into the sleeve 40. If desired, the bore 54 may be threaded so as to engage the external threads on the threaded portion 50. The sleeve 40 has internal threads 56 which engage the threads on the threaded portion 50. The fastening member 46 secures the body portion 12 to the neck portion 14 via the sleeve 40.

As shown in FIG. 1, the head portion 48 of the fastening member 46 may have an integrally formed insert 58 with a bore 60 for receiving a tool (not shown) such as an Allen wrench. The tool may be used to loosen the fastening member 46 so it can be removed or to tighten the fastening member 46 so that the neck portion 14 is secured in position.

As previously discussed, the locking system 16 allows the neck portion 14 to be changed as needed with ease and in a relatively short time. The locking system 16 also insures that the neck portion 14 is well secured to the body portion 12 so that it stays in position. Still further, the locking system 16 maintains the neck portion 14 in perfect alignment with the body portion 12.

The members 18 and 24, the threaded sleeve 40, the neck portion 14, and the body portion 12 may be formed from any suitable materials known in the art.

While the present invention has been described in the context of a guitar or a bass, it should be recognized that the present invention has broad applicability to a wide range of stringed musical instruments. For example, the locking system of the present invention could be used to secure a neck portion of a violin to a body portion. It could also be used with other stringed musical instruments such as cellos, upright basses, and violas.

It is apparent that there has been provided in accordance with the present invention a musical instrument with detachable neck which fully satisfies the objects, means, and advantages set forth hereinbefore. While the present invention has been described in the context of specific embodiments thereof, other alternatives, modifications, and variations will become apparent to those skilled in the art having read the foregoing detailed description. Accordingly, it is intended to embrace those alternatives, modifications, and variations as fall within the broad scope of the appended claims.

What is claimed is:

1. A stringed musical instrument comprising:

a body portion;

a second portion adapted to be attached to said body portion;

a first member attached to a surface of said second portion, said first member having a positioning member;

said second portion having a shaped region for receiving an edge of said first member;

a second member attached to said body portion having a receiving portion for receiving and mating with said positioning member on said first member;

said positioning member having a shape and said receiving portion having a shape corresponding to the shape of said positioning member; and means for releasably securing said second portion to said body portion and for maintaining proper alignment between the body portion and the second portion.

2. A stringed musical instrument according to claim 1, wherein said positioning member is centrally located on said first member and said receiving portion is centrally located on said second member.

3. A stringed musical instrument according to claim 1, wherein said positioning member is V-shaped with an apex of said V-shaped positioning member having a length which extends parallel to a longitudinal axis of said first member and said receiving portion is V-shaped with an apex of said V-shaped receiving portion having a length which extends parallel to a longitudinal axis of said first member.

4. A stringed musical instrument according to claim 1, wherein said body portion has a groove and said second member has a tongue which fits into said groove.

5. A stringed instrument comprising:

a body portion;

a second portion adapted to be attached to said body portion;

means for releasably securing said second portion to said body portion and for maintaining proper alignment between the body portion and the second portion;

a first member attached to a surface of said second portion;

a second member attached to said body portion;

said second member having a receiving portion for engaging said positioning member; and wherein said first member has a first bore and said second member has a second bore aligned with said first bore and said releasable securing means further comprises a threaded sleeve positioned within said first and second bores.

6. A stringed musical instrument according to claim 5, wherein said threaded sleeve is attached to said first and second members.

7. A stringed musical instrument according to claim 5, wherein said threaded sleeve has internal threads and said releasable securing means further comprises a threaded fastener for engaging said internal threads.

8. A stringed musical instrument according to claim 7, wherein said body portion has a recess and said threaded fastener has a head portion which rests within said recess.

9. A stringed musical instrument according to claim 8, wherein said head portion has a bore for accommodating a tool for loosening and tightening said threaded fastener.

10. A guitar comprising:

a body portion;

a detachable neck portion;

said neck portion having a plate member;

said body portion having a second member attached to a rear portion;

said plate member having a longitudinally extending V-shaped positioning member with an apex of said V-shaped positioning member having a length which extends parallel to a longitudinal axis of said plate member; and said second member having a longitudinally extending V-shaped receiving portion with an apex of said V-shaped receiving portion having a length which extends parallel to a longitudinal axis of said second member for engaging said positioning member so as to maintain said neck portion in alignment with said body portion.

11. A guitar according to claim 10, further comprising means for releasably securing said neck portion to said body portion.

12. A guitar comprising:

a body portion;

a detachable neck portion;

said neck portion having a plate member;

said body portion having a second member attached to a rear portion;

said plate member having a longitudinally extending V-shaped positioning member;

said second member having a longitudinally extending V-shaped receiving portion for engaging said positioning member so as to maintain said neck portion in alignment with said body portion;

means for releasably securing said neck portion to said body portion;

wherein said securing means comprises a threaded sleeve attached to said plate member and said second member and a threaded fastener for engaging said threaded sleeve so as to secure said neck portion to said body portion and to maintain said neck portion in a constant position with respect to said body portion.

13. A guitar according to claim 12, wherein said threaded sleeve is positioned within a first bore in said plate member and a second bore in said second member, said second bore being aligned with said first bore.

* * * * *